US005902164A

United States Patent [19]

Shoemaker

[11] Patent Number: 5,902,164

[45] Date of Patent: May 11, 1999

[54] RETRACTABLE SURFBOARD LEASH

[76] Inventor: Michael J. Shoemaker, San Diego, Calif.

[21] Appl. No.: 09/054,644

[22] Filed: Apr. 3, 1998

[51] Int. Cl.[6] ..... A63C 15/06

[52] U.S. Cl. ..... 441/75; 242/379.2

[58] Field of Search ..... 441/75; 119/124; 242/379.2, 375

[56] References Cited

U.S. PATENT DOCUMENTS

| | | | |
|---|---|---|---|
| 4,938,725 | 7/1990 | Beck | 441/75 |
| 5,490,805 | 2/1996 | Bredesen | 441/75 |

FOREIGN PATENT DOCUMENTS

| | | | |
|---|---|---|---|
| WO9200873 | 1/1992 | WIPO | 441/75 |

*Primary Examiner*—Jesus D. Sotelo
*Attorney, Agent, or Firm*—Brown, Martin, Haller & McClain

[57] ABSTRACT

A retractable surfboard leash assembly including means for adjusting the exposed length thereof between the surfboard and the surfboard rider including an elongated, flexible leash defined by spaced-apart first and second distal ends, a housing forming an enclosed volume therein, a shaft centrally mounted in the housing; a spool pivotally mounted on the shaft inside said housing to which the first distal end of the leash is attached and a device provided in the enclosed volume to wind a length of the leash thereupon in an orderly fashion, a spring attached to the spool for winding and simultaneously storing potential energy when the leash is pulled from the housing, through an aperture formed therein, and unwinding and simultaneously releasing the stored potential energy when the leash is released to re-enter the housing for winding and storing therein, a cuff for attaching the housing to the surfboard rider and a device on the surfboard for attaching the second distal end of the leash, and diffuser device attached about the aperture in the housing and embracing the leash for controlling the inner and outer movement of the leash and preventing the wound leash inside the housing from jamming against the aperture and interfere with free movement of the leash therethrough.

18 Claims, 4 Drawing Sheets

RETRACTABLE SURFBOARD LEASH

BACKGROUND OF THE INVENTION

1. Field of the Invention

This invention pertains to the field of leashes. More particularly, this invention relates to a device for dispensing and retrieving leashes strung between a surfboard and the operator, such as the surfer.

2. Description of the Prior Art

It is axiomatic that, once a person gets on a surfboard there is a risk he or she will become separated from it at some time during the "ride". In fact, the risk of falling off a surfboard is a significant part of the sport. Surfers constantly strive to remain on the board during all manner of wave action; however, everyone knows and appreciates that in some instances, such as heavy wave action or unpredictable surf, the person will "wipe-out" as the vernacular describes it.

Surfboards are made of lightweight materials including plastic foam, usually with an interior wood stringer, and are covered with a hard finish including fiberglass and fiberglass resin. While light and sturdy, a surfboard nevertheless becomes dangerous should it be forced to double back upon its owner after a wipe out. Further, where more than one surfer is operating, one surfer's board may become exceedingly dangerous to a neighboring surfer during heavy wave action.

There has been a move toward retaining a link between the surfer and his or her surfboard. Leashes have been fashioned that have spaced-apart distal ends attached to the surfer and to the board, respectively, in order not to allow the board to become too dislocated from its owner. While leashes have served the intended purpose, they have created a host of problems that have proved to be as dangerous or more dangerous, as well as bothersome, to the art of surfboarding.

A leash will prevent a total loss of the board from its owner. However, because the specific gravity of the surfboard is quite a bit less than that of the surfer, the surfboard floats to the surface first, and can become a hazard, i.e., colliding with the surfer, resulting in cuts, scrapes and welts. In addition, the leash drags in the water and interrupts the smooth flow of water over the board. This is thought to adversely affect surfboard performance and to detract from the beauty of the sport.

Some persons have gone to stretchable leashes in order to use a shorter leash with less chance for the length to become a bothersome drag in the water when riding the board. These have proved to be extremely dangerous because the recoil built into the leash often causes the surfboard to act like a torpedo in the water and close directly on the person having the other end of the leash attached his/her body. Numerous instances of severe collision using stretchable leashes have been reported.

About the best that can be done by today's standards is the use of a retractable leash. It can be made non-stretchable thus eliminating the torpedo problem. The unused length of the leash may be wound up and temporarily stored in a housing worn by the surfer on his or her arm or ankle (Patent No. PCT/AU91/0031), or a windup spring used to wind the unused length of the leash into a housing located on the board (U.S. Pat. No. 4,938,725). In this latter patent, the windup spring stores increased potential energy as the leash is pulled out of the housing that is converted to kinetic energy as the spring retracts the unused length of the leash into the housing. The spring loses energy as it winds in the leash thus reducing the pull on the leash and reducing the torpedo problem as the surfboard gets closer to the surfer. A significant benefit with the retractable leash is that there is no excess length to drag in the water during use of the surfboard—the leash is wound up in the housing and the only part of it remaining outside the housing is the length directly from the housing to the user's ankle or arm.

The main drawback with retractable leashes of the prior art is that the leash jams in the opening in the housing during high speed unwinding and rewinding. This is mainly caused by the reflexes of the surfer in moving quickly from one location to another on the top of the surfboard. In these swift and usually unexpected movements, the leash changes angle at the inlet/outlet aperture in the housing and often causes a loop of leash inside the housing, directly under the aperture, to jam in the housing thus preventing further use of the retracting aspect of the device.

SUMMARY OF THE INVENTION

This invention is a retractable leash for use with surfboards. The main novelty of the invention is in its unique ability to handle long lengths of leash during playing out the leash and retracting the leash without the leash getting jammed in the housing or other retractable collection device.

The invention is a retractable surfboard leash assembly including means for adjusting the exposed length thereof between the surfboard and the surfboard rider comprising an elongated, flexible leash defined by spaced-apart distal ends; a housing forming an enclosed volume therein; a central shaft mounted in the enclosed volume in the housing; reel means pivotally mounted on the shaft inside the housing to which one distal end of the leash is attached, and means provided in the enclosed volume to wind a length of the leash therein in orderly fashion; a spring attached to the reel for winding and simultaneously storing potential energy when the leash is pulled from the housing through an aperture formed therein, and unwinding and simultaneously releasing the stored potential energy when the leash is released to re-enter the housing for winding and storing therein; a cuff for inter-attachment the surfboard rider and the other distal end of the leash, and diffuser means attached about the aperture in the housing and embracing the leash to control the inner and outer movement of the leash to prevent the rewinding leash from jamming inside or outside the housing against the aperture to interfere with free movement of the leash therethrough. The diffuser preferably includes a short throat section in concentric alignment with the aperture in the housing that extends beyond the housing and is larger in inside diameter than the size of the leash, all for aiding the leash in exiting and entering the housing.

Accordingly, the main object of this invention is a retractable leash for a surfboard that will not jam when retracting the leash into the housing so that no extraneous lengths of the leash will be allowed to remain outside the housing that will harm or degrade the user's performance on the vehicle. Other objects of the invention include a novel retractable leash assembly that may be worn on the user or mounted on or in the surfboard itself; a leash assembly that does away with the common problems of torpedo-like dangers of surfboards separated from their owner; a leash assembly that will allow the user to obtain full enjoyment of his or her surfboard without detraction from a jammed or broken leash retraction system; a retractable leash assembly that may be moved from surfboard-to-surfboard and surfer-to-surfer without hindrance; and, a retractable leash assembly that may be retrofitted onto any surfboard.

These and other objects of the invention will become more apparent when one reads the following specification, taken together with the drawings that are attached hereto. The scope of protection sought by the inventor may be gleaned from a fair reading of the claims that conclude this specification.

DESCRIPTION OF THE PREFERRED EMBODIMENTS

Turning now to the drawings wherein elements are identified with numerals, and like elements are identified with like numerals throughout the eight figures, this invention 1 is shown to be applicable to the combination of a surfboard 3 and a surfer 5 where it may be worn on the surfer (FIGS. 1–3) or mounted on the surfboard (FIGS. 4–7). This invention finds use with all manner of surfboards and all manner of users, whether he or she is a child, adult, or senior citizen, and all such usages and applications are fully contemplated herein.

Figure 1:
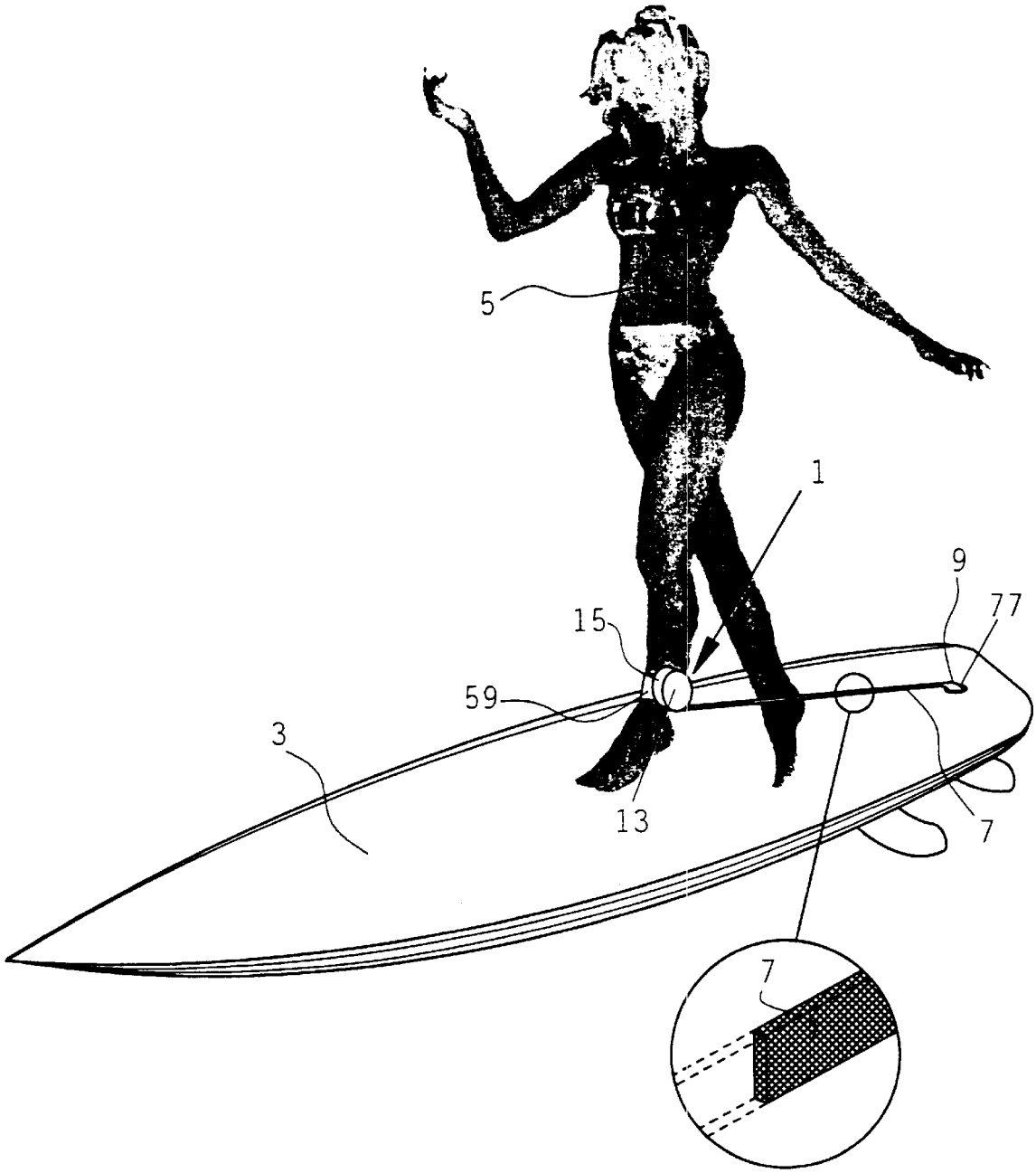
FIG. 1 is an illustrative view of a surfer riding a surfboard using one embodiment of the invention disclosed and claimed herein.

As shown in FIG. 1, this invention is a retractable surfboard leash assembly comprising an elongated, flexible leash 7 made of flexible material such as a narrow woven strap-like material, having a rather flat cross-section as shown, made of nylon, cotton or other such material. Leash 7 is usually of a length exceeding seven feet or more, has cross-sectional dimensions such as 1/16 of an inch thick and 3/8 of an inch wide, and is always defined by spaced-apart first and second distal ends 9 and 13. While leash 7 is shown in this application in strap-like form, other geometries of the leash, including circular, are fully contemplated herein.

Figure 2:
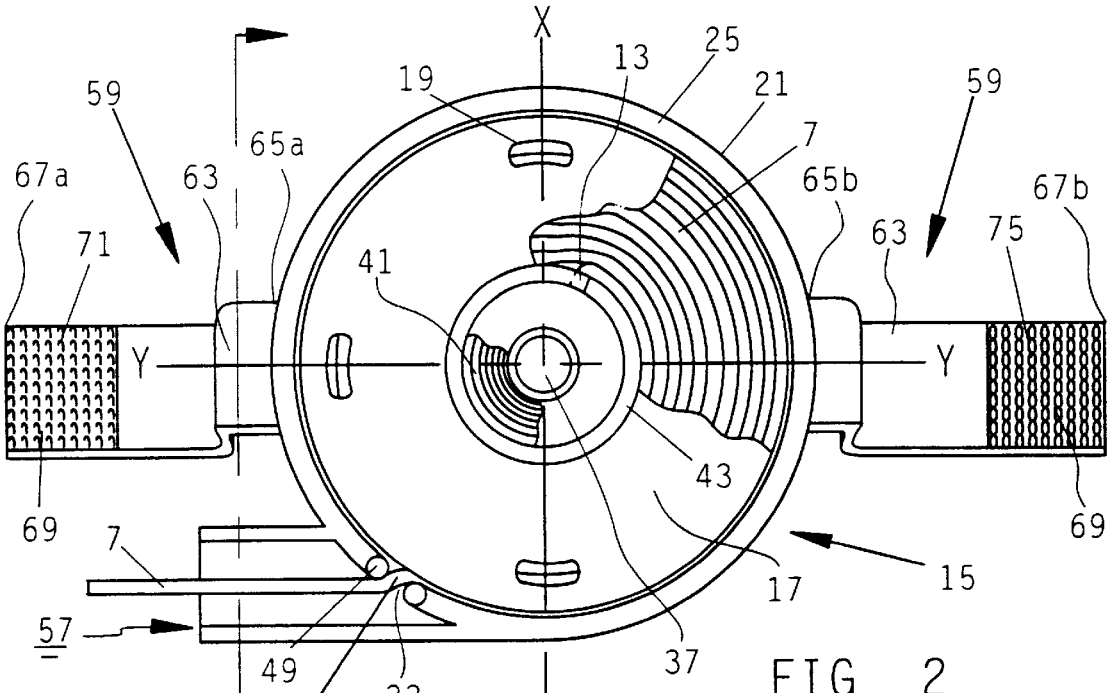
FIG. 2 is an illustrative view, partially in section, of one embodiment of this invention showing the interior of the housing and the various components located inside and outside thereof.
Figure 4:
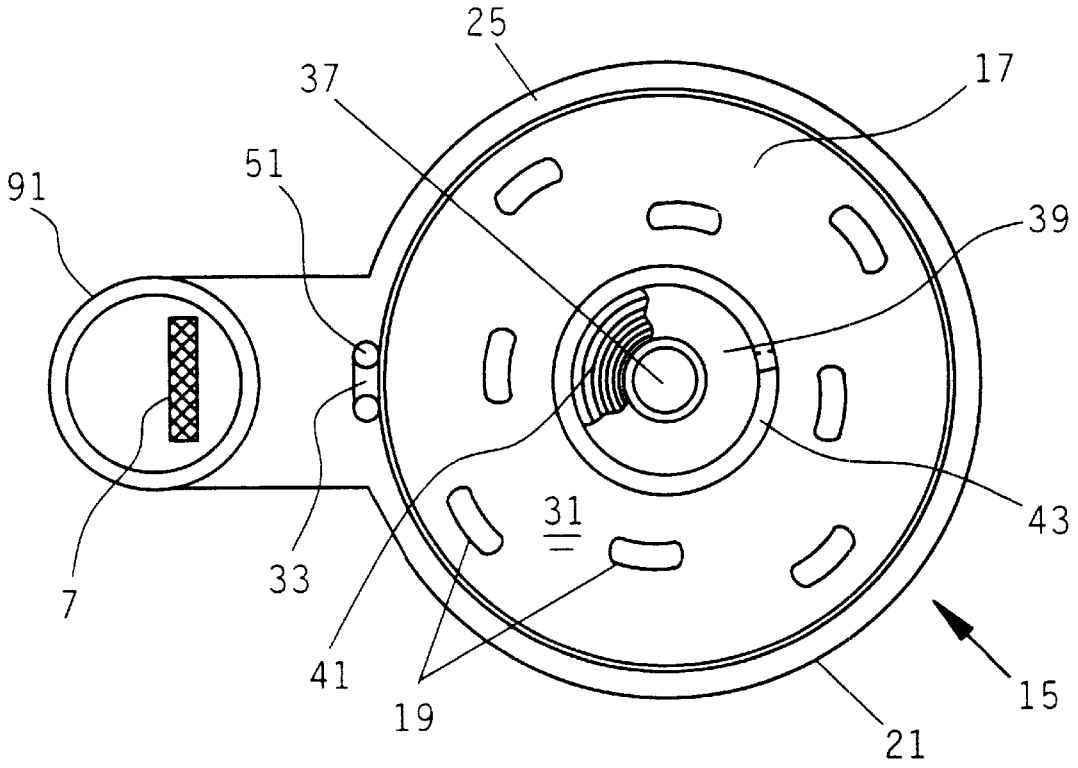
FIG. 4 is another illustrative view, partly in section, of an embodiment of the invention that is insertable in a chamber formed inside the surfboard, shown without a leash inside.

As shown in FIG. 2, in the embodiment worn on the ankle of the surfer, a housing 15 is provided comprising a flat base 17, designed to fit against an extremity of the surfer, such as his or her arm or ankle. It is preferred that housing 15 be made of a material inert to the corrosive effects of sea water such as saltwater-inert formulations of plastics. Base 15 is made either solid, as shown in FIG. 2, or, more preferable, reticulated and has numerous perforations 19 formed therethrough, as shown in FIG. 4, to allow water to drain from housing 15. Base 17 is defined by a circular perimeter 21 from which housing side walls 25 extend upward to terminate at a top plane 27. A top panel or cover 29 is also provided covering said side walls 25 and housing 15 about top plane 27 to form an enclosed volume 31 therein for the storage of portions of leash 7 when not in use. Perforations 19 may also be formed in cover 29 to aid in allowing water, trapped in housing, to escape. An entrance/exit aperture 33 is formed in housing side wall 25 to allow leash 7 to enter or exit enclosed volume 31.

As shown in FIGS. 2 and 4, a center shaft 37 is mounted centrally in volume 31 inside housing, 15 and transverse to the plane, X-Y, of housing 15. A spring housing 39 is mounted on shaft 37 inside housing 17 and contains a windable spring 41 therein connected at one end to shaft 37. A spool 43 is provided, over spring housing 39 and inside volume 33 for combination with spring 41, for the purpose of holding one end of leash 7 and any unused length of leash 7 and for turning to allow leash 7 to be withdrawn from housing 15 such as when the surfer has parted from the surfboard and the leash is pulled out in following the surfboard. During this action, spring 41 is twisted by spool 43 and tightened to store ever-increasing amounts of potential energy as it winds tighter. Spring 41 then converts the stored potential energy in its twisted form to kinetic energy as it unwinds and drives spool 43 in a rotational motion to take in leash 7, such as when the surfer has regained possession of his or her surfboard and the leash becomes effectively shortened.

Figure 3:
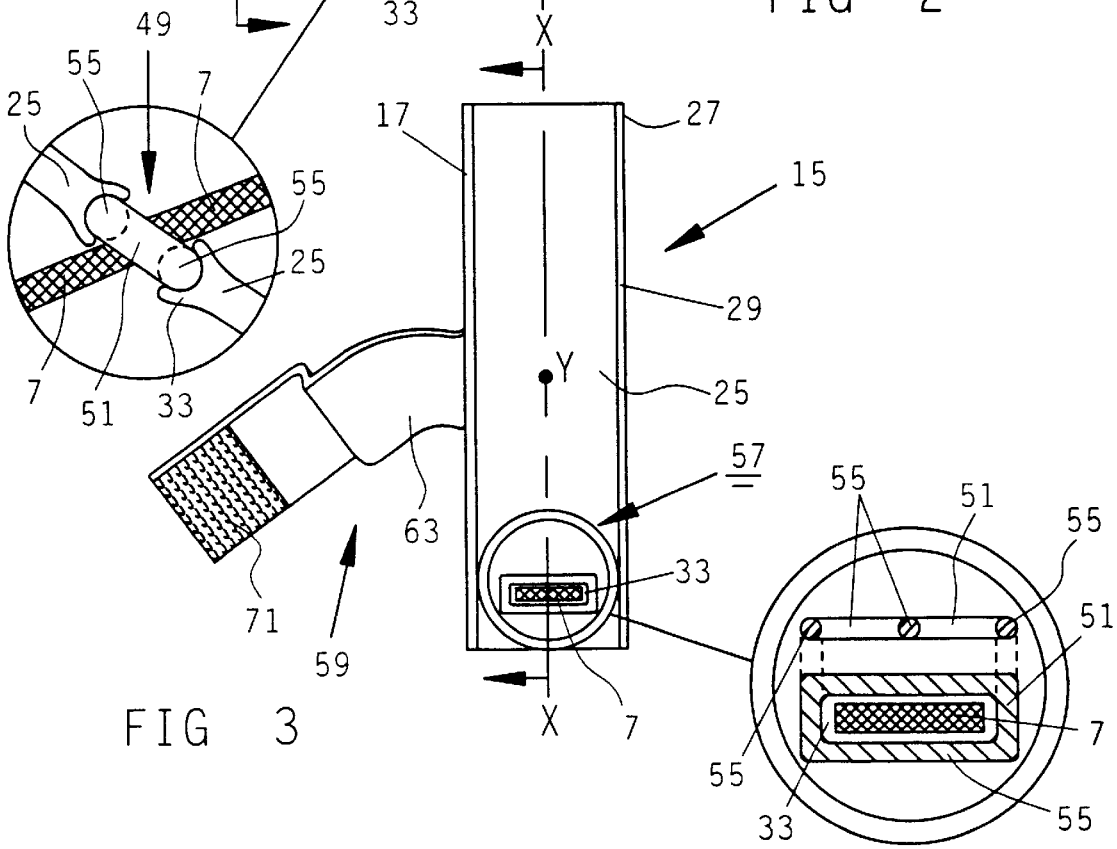
FIG. 3 is a side view of the embodiment shown in FIG. 2.
Figure 8:
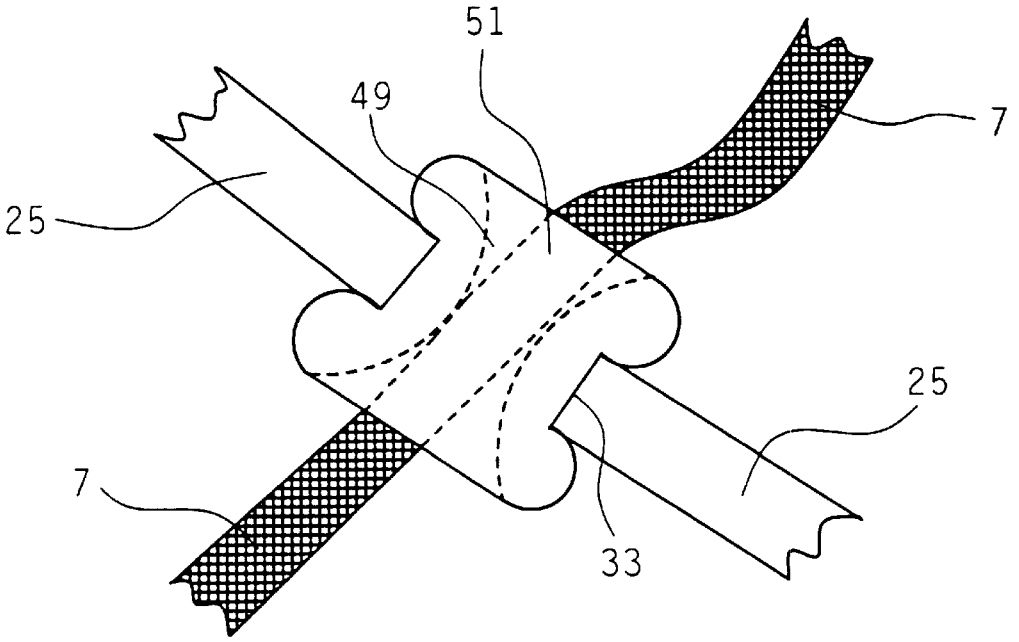

Aperture 33 is formed in housing side wall 25 to allow leash 7 to pass therethrough when being withdrawn from or being rewound into housing 15. Aperture 33 is preferably made slightly larger than the cross-section of leash 7, whether round (for a round leash) or flattened (for a belt-like leash as shown in the figures. Optionally, a leash guide 49 may be provided for guiding leash 7 through aperture 33. As shown in FIGS. 2 and 3, leash guide 49 may take the form of a frame 51, of the same general outside configuration as the specific leash used, such as shown in FIG. 3 to be a rectangular frame 53 with rounded legs 55 attached together at their intersecting distal ends and slightly larger in size to allow leash 7 to easily pass therethrough or pass therethrough at an angle as shown in FIGS. 2 and 8. Frame 51 may be loosely or tightly mounted and still perform its function correctly. As shown in FIG. 2, frame 51 is tightly fastened about its outer perimeter in aperture 33 wherein aperture 33 has concave edges to accept frame legs 55 therein in a tight press fit. Frame 51 may also be made in a loose fit, as shown in FIG. 8, where the edges of frame 51 are loosely "folded over" and about aperture 33.

As shown in FIGS. 2 and 3, a diffuser means 57 is provided attached to housing 15 about housing aperture 33 for the purpose of enhancing the feed of leash 7 into and out of housing 15. Diffuser means 57 also aids in feeding leash 7 into housing 15 in an orderly fashion and helps prevent jamming of leash 7 in aperture 33 as is a constant problem with such devices of the prior art. Diffuser means 57 embraces leash 7 and is preferably tubular and concentrically formed about leash 7 or is formed about leash 7 to allow it to pass therethrough and be in full control of leash 7 as it is pulled at various angles from said housing. As shown in FIGS. 2 and 3, diffuser means 57 is formed tangential to housing side walls 25 and extends outward therefrom beyond housing 15. It is preferred that diffuser means 57 have an inside diameter greater than the maximum cross-sectional dimension of said leash 7.

It is preferred in this invention that housing base 17, housing side walls 25, and diffuser means 57 are all made in one monolithic piece. The preferred means is by injection molding to keep the cost of manufacture to a minimum. It is even further preferred that center shaft 37 be made as part of the monolithic piece to reduce manufacturing costs even further.

As shown in FIGS. 2 and 3, a cuff 59 is provided for the surfer or other water sport activist to wear on their arm, ankle, or other body extremity, but preferably their ankle, and comprises a pair of straps 63, each having one distal end 65*a* and 65*b*, respectively, attached to the underside of housing 15, such as to housing base 17. The other distal ends, 67*a* and 67*b*, of straps 63, terminate in pads 69, one pad containing hook elements 71 and the other containing loop element 73. Hook elements 71 and loop elements 73 are resilient and deformable and, when pressed together, become removably entangled, securing straps 63 together in overlapping end arrangement. Straps 63 can be released from entangled engagement by positively pulling hook elements 71 away from loop elements 75 or vice versa. The loop and hook fabric elements 71 and 75 are available under the trademark "Velcro", more specific details of which may be had from U.S. Pat. No. 2,717,437 titled VELVET TYPE FABRIC AND METHOD OF PRODUCING SAME issued Sep. 13, 1955 to George de Mestral and U.S. Pat. No. 3,114,951 titled DEVICE FOR JOINING TWO FLEXIBLE ELEMENTS issued Dec. 24, 1963 to George de Mestral. The material is hereinafter referred to as "Velcro®" loop material and "Velcro®" hook material, a product of American Velcro, Inc.

This invention may be employed by wearing housing 15 on one's arm or ankle, preferably their ankle, and having the other distal end of leash 7 attached to catch means 77 located on surfboard 3. As shown in FIGS. 4–7, the invention may also be employed by mounting housing 17 inside surfboard 3 and directing leash 7 outward therefrom to catch means 77 worn on the ankle of the surfer.

Figure 5:
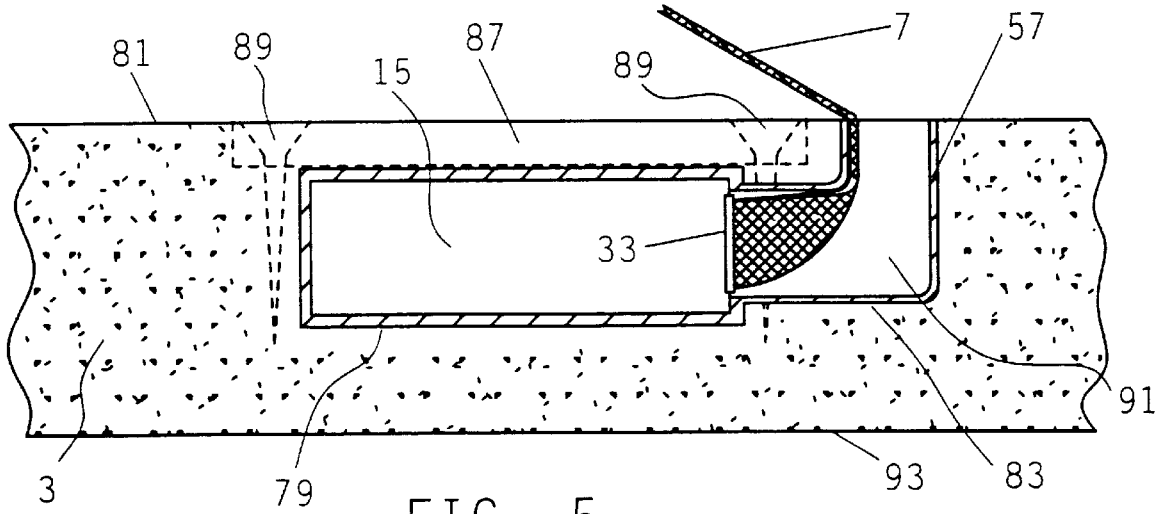
FIG. 5 is a side view of the embodiment of the invention inserted into the surfboard from the top surface thereof.

In this embodiment of the invention and, as shown in FIG. 5, diffuser means 57 is not mounted tangentially to housing side walls 25 but is mounted centrally of the housing and extends outward from housing side walls 25 in a radial direction. In addition, housing 15 is made narrow to allow it to be conveniently inserted in a surfboard. However, all other components of the invention are present in their above-described location and with the same interaction. As shown in FIG. 5, a cell or recess 79 is hollowed out through the top surface 81 of surfboard 3, of the size and shape of housing 15. A second area 83 is hollowed out for diffuser means 57 to fit. Housing 15 is inserted flat-like in recess 79 and a cover plate 87 laid over top thereof to bring the surface of recess 79 up to the top surface 81 of surfboard 3 and thereafter fastened with screws 89 or the like. Diffuser means 57 is extended from housing 15 as aforesaid and an elbow 91 formed therein and turned to face upward and terminated flush with surfboard top surface 81 primarily to effect a change in direction of leash 7 as it exits and enters housing 15. This is done so that leash 7, as it exits housing 15, is directed outward and upward to the surface of surfboard 3 to thereafter pass directly to catch 77 worn on the ankle of surfer 5, similar to what is shown in FIG. 1.

Figure 6:
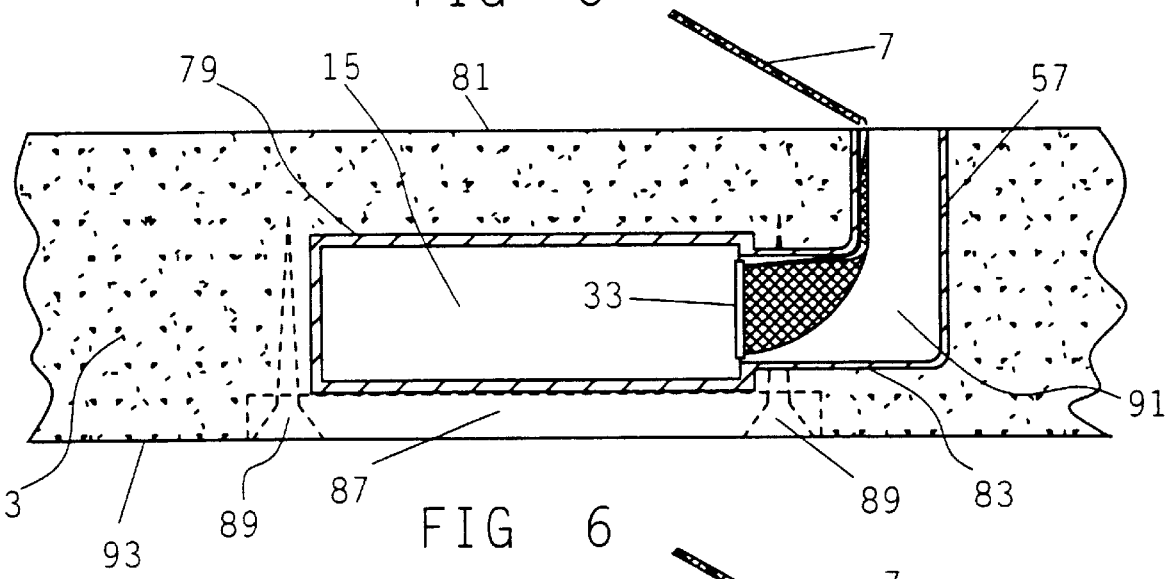
FIG. 6 is a side view of the embodiment of the invention inserted into the surfboard from the bottom surface thereof.
Figure 7:
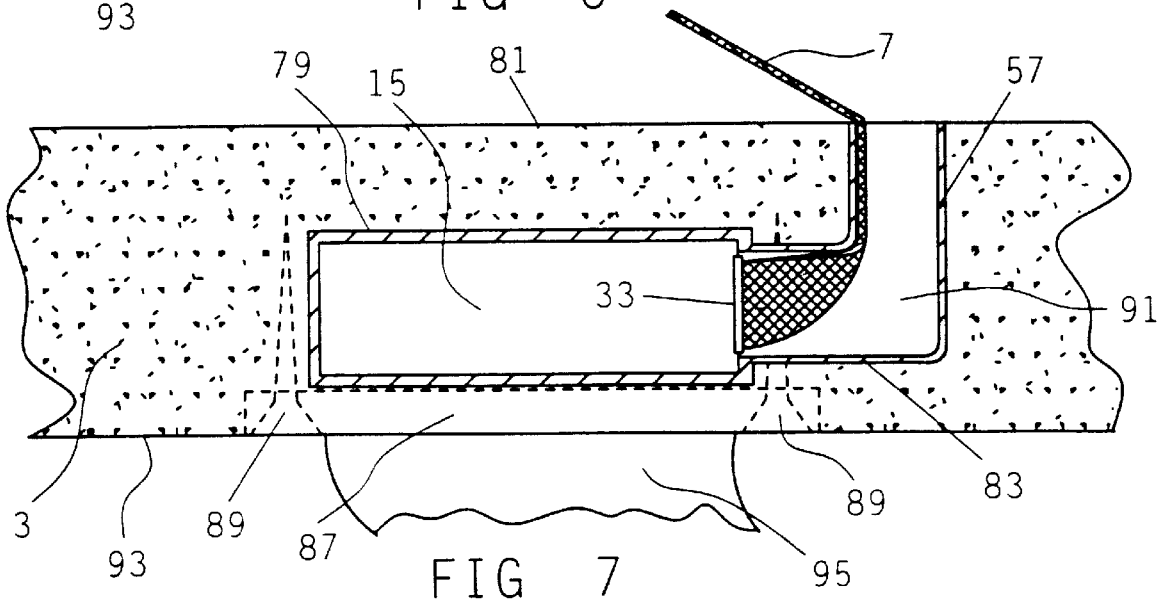
FIG. 7 is a view similar to that shown in FIG. 6 where a rudder is formed in the cover plate covering the housing; and, FIG. 8 is a close-up view of another embodiment of the frame and shows how it is mounted in the aperture formed in the housing.

As shown in FIG. 6, the embodiment of FIG. 5 is slightly modified to have recess 79 formed in the bottom of surfboard 3 and housing 15 mounted in recess 79. Cover plate 87 is now applied to the bottom surface 93 of surfboard 3 and diffuser means 57 is lengthened to extend all the way to top surfboard surface 81 with elbow 91 between housing exit aperture 31 and top surfboard surface 81. As shown in FIG. 7, the embodiment of FIG. 6 is slightly modified to form a surfboard rudder 95 on cover plate 87 so that mounting both housing 17 and rudder 95 is accomplished in one operation.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the way to achieve substantially the same result are within the scope of this invention.

What is claimed is:

1. A retractable surfboard leash assembly including means for adjusting the exposed length thereof between the surfboard and the surfboard rider comprising:

a) an elongated, flexible, flat, belt-like leash defined by spaced-apart first and second distal ends;

b) a housing forming an enclosed volume therein;

b) a shaft centrally mounted in said housing;

c) a spool pivotally mounted on said shaft inside said housing to which said first distal end of said leash is attached for winding a length of said leash thereupon in orderly fashion;

d) a spring attached to said spool for winding and simultaneously storing potential energy when said leash is pulled from said housing, through an aperture formed therein, and unwinding and simultaneously releasing said stored potential energy when said leash is released to re-enter said housing for winding and storing therein;

e) a cuff for attaching said housing to the surfboard rider and means on the surfboard for attaching said second distal end of said leash; and, f) diffuser means attached about said aperture in said housing and embracing said leash for controlling the inner and outer movement of said leash and preventing the wound leash inside said housing from jamming against said aperture and interfere with free movement of said leash therethrough.

2. The retractable surfboard leash assembly of claim 1 wherein said housing includes:

a) a flat base forming an extended surface bounded by a circular outer perimeter;

b) housing side walls extending upward from said perimeter to terminate at a top plane; and, c) a top panel covering said side walls at said top plane to form said enclosed volume therein.

3. The retractable surfboard leash assembly of claim 2 further including a plurality of apertures formed in said housing to drain water therefrom.

4. The retractable surfboard leash assembly of claim 1 further including a leash guide located at said aperture to enhance the guiding of said leash out of and into said housing.

5. The retractable surfboard leash assembly of claim 4 wherein said leash guide includes a rectangular frame comprised of legs intersecting at their respective distal ends wherein said legs are rounded to provide reduced friction to said leash.

6. The retractable surfboard leash assembly of claim 5 wherein said frame is tightly fixed about said aperture.

7. The retractable surfboard leash assembly of claim 5 wherein said frame is loosely fixed about said aperture.

8. The retractable surfboard leash assembly of claim 1 wherein said diffuser means is tubular, surrounds said leash guide and is concentrically formed about said aperture and has an inside diameter greater than the maximum cross-sectional dimension of said leash.

9. The retractable surfboard leash assembly of claim 1 wherein said diffuser means is tubular, extends tangentially from said housing side walls and extends beyond said side walls of said housing.

10. The retractable surfboard leash assembly of claim 1 further including a cuff for temporarily mounting said housing to the ankle of the person operating the surfboard.

11. The retractable surfboard leash assembly of claim 10 wherein said cuff includes overlapping pads of hook and loop fabric that are arranged for removable engagement therebetween.

12. A retractable surfboard leash assembly including means for adjusting the exposed length thereof between the surfboard and the surfboard rider comprising:

a) an elongated, flexible, flat, belt-like leash defined by spaced-apart first and second distal ends;

b) a housing forming an enclosed volume therein;

b) a shaft centrally mounted in said housing;

c) a spool pivotally mounted on said shaft inside said housing to which said first distal end of said leash is attached for winding a length of said leash thereupon in orderly fashion;

d) a spring attached to said spool for winding and simultaneously storing potential energy when said leash is pulled from said housing, through an aperture formed therein, and unwinding and simultaneously releasing said stored potential energy when said leash is released to re-enter said housing for winding and storing therein;

e) said housing formed in narrow construction to allow it to be inserted within a recess formed in the surfboard from the top surface thereof; and, f) diffuser means attached to said housing about said aperture and extending from said side walls in a radial direction for embracing said leash for controlling the inner and outer movement of said leash and preventing the wound leash inside said housing from jamming against said aperture and interfere with free movement of said leash therethrough.

13. The retractable surfboard leash assembly of claim 12 wherein said diffuser means is arranged to end flush with the top surface of the surfboard.

14. The retractable surfboard leash assembly of claim 12 further including a cover plate for placement over said housing to fill said recess to the top surface of the surfboard.

15. A retractable surfboard leash assembly including means for adjusting the exposed length thereof between the surfboard and the surfboard rider comprising:

a) an elongated, flexible leash defined by spaced-apart first and second distal ends;

b) a housing forming an enclosed volume therein;

b) a shaft centrally mounted in said housing;

c) a spool pivotally mounted on said shaft inside said housing to which said first distal end of said leash is attached for winding a length of said leash thereupon in orderly fashion;

d) a spring attached to said spool for winding and simultaneously storing potential energy when said leash is pulled from said housing, through an aperture formed therein, and unwinding and simultaneously releasing said stored potential energy when said leash is released to re-enter said housing for winding and storing therein;

e) said housing formed in narrow construction to allow it to be inserted within a recess formed in the surfboard from the bottom surface thereof; and, f) diffuser means attached to said housing about said aperture and extending from said side walls in a radial direction for embracing said leash for controlling the inner and outer movement of said leash and preventing the wound leash inside said housing from jamming against said aperture and interfere with free movement of said leash therethrough.

16. The retractable surfboard leash assembly of claim 15 wherein said diffuser means is arranged to end flush with the top surface of the surfboard and further including a cover plate for placement under said housing to fill said recess to the bottom surface of the surfboard.

17. A retractable surfboard leash assembly including means for adjusting the exposed length thereof between the surfboard and the surfboard rider comprising:

a) an elongated, flexible leash defined by spaced-apart first and second distal ends;

b) a housing forming an enclosed volume therein;

b) a shaft centrally mounted in said housing;

c) a spool pivotally mounted on said shaft inside said housing to which said first distal end of said leash is attached for winding a length of said leash thereupon in orderly fashion;

d) a spring attached to said spool for winding and simultaneously storing potential energy when said leash is pulled from said housing, through an aperture formed therein, and unwinding and simultaneously releasing said stored potential energy when said leash is released to re-enter said housing for winding and storing therein;

e) said housing formed in narrow construction to allow it to be inserted within a recess formed in the surfboard from the bottom surface thereof;

f) diffuser means attached to said housing about said aperture and extending from said side walls in a radial direction for embracing said leash for controlling the inner and outer movement of said leash and preventing the wound leash inside said housing from jamming against said aperture and interfere with free movement of said leash therethrough; and, g) a cover plate for placement under said housing to fill said recess to the bottom surface of the surfboard.

18. The retractable surfboard leash assembly of claim 17 wherein said diffuser means is arranged to end flush with the top surface of the surfboard and a rudder if formed on said cover plate to be placed at the bottom surface of the surfboard.

* * * * *